United States Patent [19]

Dür

[11] 4,372,537

[45] Feb. 8, 1983

[54] METHOD AND APPARATUS FOR THE REPLACEMENT OF BOTTOM CLOSURES OF TRACK-MOUNTED TRANSFER LADLES

[75] Inventor: Bernhard Dür, Oetwil am See, Switzerland

[73] Assignee: Metacon AG, Zurich, Switzerland

[21] Appl. No.: 324,948

[22] Filed: Nov. 25, 1981

[30] Foreign Application Priority Data

Dec. 8, 1980 [DE] Fed. Rep. of Germany ..... 3046194

[51] Int. Cl.[3] ..... C21B 3/00

[52] U.S. Cl. ..... 266/45; 266/165; 266/142; 266/271; 105/238 R

[58] Field of Search ..... 266/165, 44, 45, 271, 266/142; 105/238 R; 432/88; 104/27, 29, 48, 49, 88, 130

[56] References Cited

U.S. PATENT DOCUMENTS 3,661,374 5/1972 Van Wieist ..... 266/165

4,260,141 4/11981 Nagati ..... 266/287

FOREIGN PATENT DOCUMENTS 54-97918 8/1979 Japan ..... 104/88

*Primary Examiner*—L. Dewayne Rutledge

*Assistant Examiner*—Christopher W. Brody

*Attorney, Agent, or Firm*—Cushman, Darby & Cushman

[57] ABSTRACT

A method and installation is disclosed for the replacement of a bottom closure of a track-mounted pugh-type transfer ladle having a transfer container supported by two longitudinally spaced-apart bogies which are pivotally attached to the transfer container for swinging movement about a vertical axis, the transfer container having a removable bottom closure located between said bogies. The ladle is moved longitudinally of itself and the two bogies are directed on to different tracks which are spaced from each other to thereby swing the bogies relative to the transfer container and increase the longitudinal space between the bogies; and thereafter the closure is replaced from below through the resulting increased space.

8 Claims, 4 Drawing Figures

METHOD AND APPARATUS FOR THE REPLACEMENT OF BOTTOM CLOSURES OF TRACK-MOUNTED TRANSFER LADLES

The invention relates to a method and apparatus for the replacement of sliding closures on the underside of track-mounted transfer ladles.

BACKGROUND

Transfer ladles of the type under consideration comprise a horizontally elongated cigar shaped transfer container having a bottom drain, the container being supported at each end on a bogie the wheels of which ride on ground-supported or floor-mounted tracks.

It has been customary in the past to design transfer ladles of the aforementioned type, so called pugh-type transfer ladles, which are used for the transport of pig iron from the blast furnace to the steel mill which may on occasion be relatively distant, so that they are rotatable about their longitudinal axis and that they may be drained by way of their top charging hole. In the course of time, a relatively large number of various vessels and ladles, such as are used in the manufacture and the processing of steel, have been provided with bottom drains which can be shut off, and it was no longer necessary to tip them. After the break-through of the sliding closure in the iron and steel industry their use in connection with such vessels has rapidly increased. Inasmuch as a movable bearing and a drive was no longer required with vessels having a bottom drain, not only the structural investment was reduced, but the drainage through a bottom drain had considerable operational advantages over the discharge by way of a pouring lip. Even though comparable advantages could be obtained for pugh-type transfer ladles, there has been no further work with bottom drains. It is true that the use of sliding closures is paired with considerable problems, since they necessitate relatively frequent replacements to renew those refractory parts which are subject to wear. Because of the great weight of the pugh-type transfer ladles with their contents, a large number of vehicle axles must be used, in order to avoid excessive axle loads. As a result, the bogie units occupy practically the entire length of the transfer ladle. While there remains enough space for the sliding closure between the neighboring ends of the bogies, there is no or insufficient access to this closure for the purpose of replacing it.

SUMMARY OF THE INVENTION

It is the purpose of this invention to simplify the operation of pugh-type transfer ladles having centrally located sliding closures with the goal of making a replacement of the sliding closures of such transfer ladles relatively simple. The invention accomplishes this by swinging the bogies in a horizontal plane (i.e. about vertical axes) relative to the transfer container so that the inner ends of the bogies (i.e. the ends facing each other) become removed from the area neighboring the longitudinal center of the ladle (i.e. the location of the bottom drain and its sliding closure). There is then sufficient space between the bogies to permit removal and replacement of the closure from below. Preferably, the swinging movement takes place by shunting the front and rear bogies onto different tracks, as the ladle is moved forwardly, and then bringing the ladle to a stop. The amount of swinging movement and hence the spacing between bogies is directly proportional to the distance between the two tracks. Inasmuch as the distance between the two neighboring rail tracks which, preferably, are in a parallel arrangement, can be chosen freely and since it is, in any case, considerably greater than the rail gauge, the replacement station may comprise a working pit, the width of which is not limited by the distance between the rails (i.e. the gauge), greatly facilitating access to the sliding closure from underneath.

DETAILED DESCRIPTION

Figure 1:
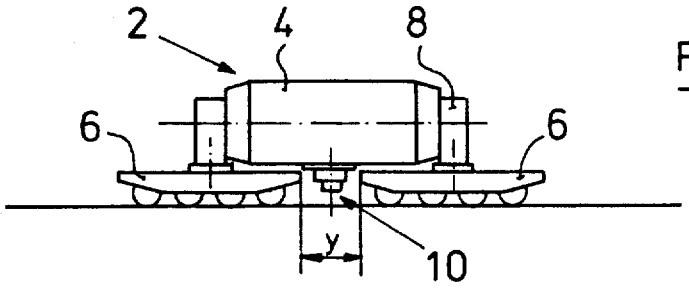
FIG. 1 is a schematic elevational view of a track-bound pugh-type transfer ladle.
Figure 2:
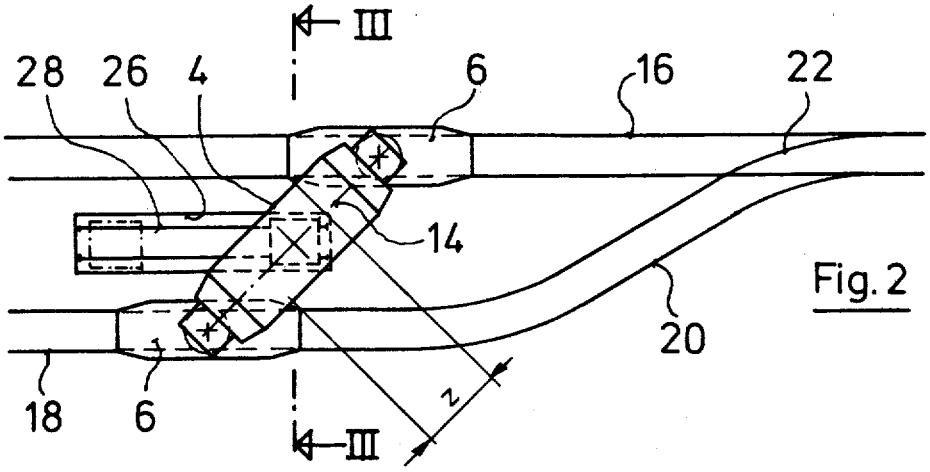
FIG. 2 is a plan view of the ladle of FIG. 1 positioned on a closure-replacement station.
Figure 3:
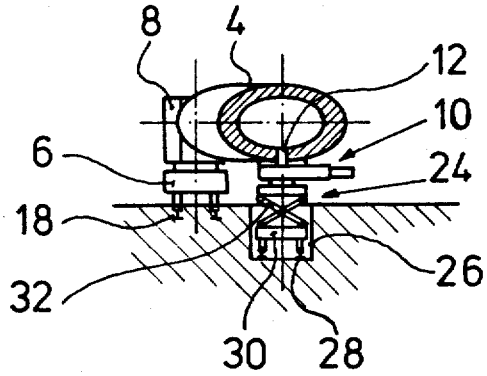
FIG. 3 is a sectional view along line III—III in FIG. 2.

As shown in FIGS. 1 and 2, a track-bound pugh-type transfer ladle 2 comprises a transfer container 4 and two bogies 6. The bogies 6 support carriers 8 which accept the ends of the transfer ladle 4 rigidly, i.e. non-rotationally. The connection between each bogie 6 and its carrier 8 permits relative rotation about a vertical axis 6*a*. A sliding closure 10 is located at the underside of the transfer container 4 at the longitudinal center thereof. The closure controls a bottom drain opening 12 of the transfer container, as can be seen in FIG. 3. Between the ends of the bogies 6 which face each other there remains a distance y which normally is insufficient for a removal of the sliding closure 10 from the transfer ladle 4 and to replace it by a repaired sliding closure.

According to the present invention, the space between the inner ends of the bogies 6 is increased to a distance z, by swinging the bogies 6 in a horizontal plane (i.e. about the axes 6*a*) in the same direction in relation to their longitudinal axis. This horizontal swing is achieved, as shown in FIG. 2, by one of the bogies 6 being transferred from a first rail track 16 onto a second rail track 18, running at a distance thereto. As is shown in FIG. 2, the second rail track 18 extends parallel to the first rail track 16 and is connected to the latter by means of a connecting section 20 and a movable shunt 22. In the arrangement as shown, the bogie 6 which was forward during the motion of the transfer ladle 2 along the rail track 16 to the left, has been deflected by the shunt 22 onto the rail track 18, while the trailing bogie 6 has remained on the rail track 16. That is, the shunt 22, which is conventional per se, is movable by means (not shown) between one position in which wheels of the front bogie are directed on to track 18 and another position in which the wheels of the rear bogie are retained on track 16.

A closure-replacement station 24 includes an oblong working pit 26 extending parallel between the rail tracks 16 and 18. Inside of the working pit 26 there is a movable roller gear table 30 with a lift mechanism 32, running on tracks 28. The lift mechanism of the roller gear table 30 permits the support of a sliding closure 10 removed from the transfer ladle 4 and to lower it, so that the sliding closure, having been lowered, can be removed from the area underneath of the transfer ladle, using tracks 28. A ready, repaired slide closure can then be placed beneath the ladle 2 in a corresponding operation and can be supported until it is fastened to the container 4.

As can be seen from FIGS. 2 and 3, sufficient space for a replacement of the sliding closure 10 at the transfer ladle 4 can be created by the described method between the bogies 6. Given certain longitudinal conditions of the transfer ladle 2, the distance z between the horizontally and identically swung bogie sections 6 can be determined by the distance of the rail tracks 16, 18 from each other.

Figure 4:
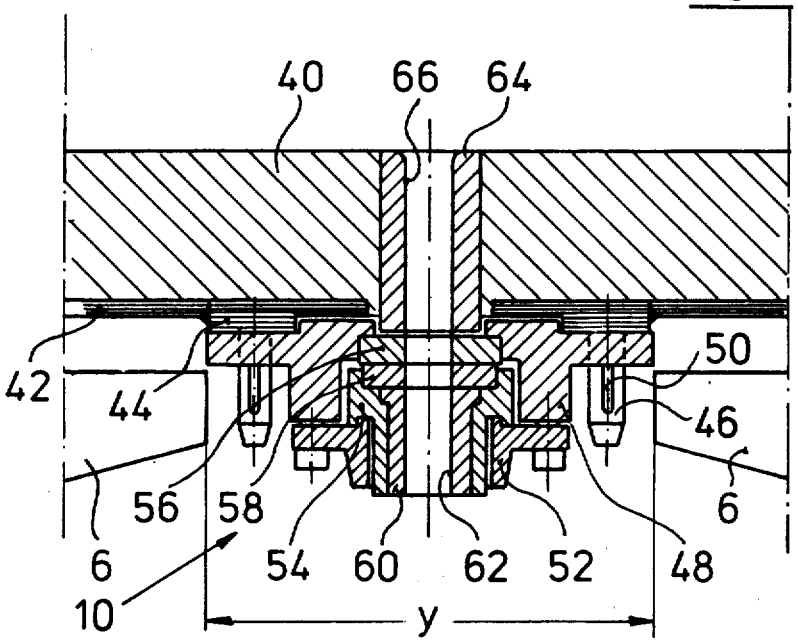
FIG. 4 is a vertical sectional view through a sliding closure fastened to a transfer ladle.

FIG. 4 shows a conventional sliding closure fastened to the transfer container 4, this illustration also showing the spatial condition between the bogies 6. The outer casing 42 of the brickwork 40 of the transfer ladle has a fastening plate 44 provided with a number of downward directed fastening bolts 46 arranged in pairs. The fastening bolts 46 traverse bores of the housing portion 48 of the sliding closure, while wedges 50 which in turn pass through the fastening bolts 46, press the closure housing 48 against the fastening plate 44. A cover 52 as well as movable closure part 54 forms a constructional unit with the housing 48, a bottom plate 56 being inserted into the housing, while the part of the closure 52 contains a slide plate 58 and a discharge sleeve 60. In the open position as shown, the bore 62 in the discharge sleeve is connected with the bottom opening 66 of the transfer ladle 4, said opening being lined with discharge tile 64.

The sliding closure 10 is removed from the transfer ladle 4 by the wedges 50 being removed from the fastening bolts 46, so that it can be removed from the fastening bolts 46 by lowering.

The performance of these tasks is possible whenever the bogies 6–in contrast to their non-swung position relative to the transfer ladle 4, as shown in FIG. 4–assume the position as shown in FIG. 2. The distance z is available for access to the slide closure 10, said distance being considerably larger than distance y. It is therefore possible to remove the wedges 50 even while the lift mechanism 32 is located under the sliding closure 10, for the purpose of supporting its weight which is in the area of 2500 kg. The sliding closure 10 also can be removed and lowered without obstruction by the bogies 6, and it can be replaced by a new one.

What is claimed is:

1. A method for the replacement of a bottom closure of a track-mounted pugh-type transfer ladle having a transfer container supported by two longitudinally spaced-apart bogies which are pivotally attached to the transfer container for swinging movement about a vertical axis, said transfer container having a removable bottom closure located between said bogies, said method comprising: moving the ladle longitudinally of itself and directing the two bogies on to different tracks which are spaced from each other to thereby swing the bogies relative to the transfer container and increase the longitudinal space beween the bogies; and replacing the closure from below through said increased space.

2. The method according to claim 1 wherein the swinging of both of the bogies is effected to the same side with respect to the transfer container.

3. An installation for the replacement of a bottom closure of a track-mounted pugh-type transfer ladle having a transfer container supported by two longitudinally spaced-apart bogies which are pivotally attached to the transfer container for swinging movement about a vertical axis, said transfer container having a removable bottom closure located between said bogies, said installation comprising: a track system including two pairs of tracks spaced from each other; a movable rail arrangement for directing one of said bogies on to one of the pairs of tracks and for directing the other bogie on to the other pair of tracks as the ladle is moved longitudinally whereby the longitudinal space between the bogies is increased by swinging of the bogies relative to the container; and a closure-replacement station located between the pairs of tracks and below the bottom of the ladle.

4. An installation as in claim 3 wherein the two pairs of tracks are parallel and wherein the replacement station includes a working pit below the level of the tracks.

5. An installation as in claim 3 or 4 wherein the movable rail arrangement includes at least one shunt.

6. An installation as in claim 4 wherein the replacement station includes a lift mechanism for raising and lowering a closure.

7. An installation as in claim 6 wherein the lift mechanism is horizontally movable longitudinally of said pairs of tracks.

8. An installation as in claim 7 wherein the lift mechanism is part of a roller gear table.

* * * * *